United States Patent [19]

Benedyk

[11] Patent Number: 4,766,664

[45] Date of Patent: Aug. 30, 1988

[54] PROCESS FOR FORMATION OF HIGH STRENGTH ALUMINUM LADDER STRUCTURES

[75] Inventor: Joseph C. Benedyk, Lake Zurich, Ill.

[73] Assignee: Alumax Extrusions, Inc., St. Charles, Ill.

[21] Appl. No.: 15,329

[22] Filed: Feb. 17, 1987

[51] Int. Cl.[4] ..... B21D 41/02

[52] U.S. Cl. ..... 29/512; 29/523; 148/12.7 A; 182/228; 219/10.43

[58] Field of Search ..... 182/228; 29/243.52, 29/512, 523; 148/12.7 A, 11.5 A, 415; 219/10.41, 10.43, 10.57; 285/382.4

[56] References Cited

U.S. PATENT DOCUMENTS

| | | | |
|---|---|---|---|
| 2,223,507 | 12/1940 | Blakeslee, Jr. et al. | 219/10.41 |
| 2,487,071 | 9/1949 | Bowlas | 219/10.43 |
| 3,039,186 | 6/1962 | Stoyer et al. | 182/228 |
| 3,061,042 | 10/1962 | Giles | 182/228 |
| 3,140,540 | 7/1964 | Greenman | 29/512 |
| 3,283,402 | 11/1966 | Larson | 182/228 |
| 3,426,867 | 2/1969 | Berger | 182/228 |
| 3,642,542 | 2/1972 | Sperry et al. | 148/12.7 A |

FOREIGN PATENT DOCUMENTS

| | | | |
|---|---|---|---|
| 921383 | 3/1963 | United Kingdom | 182/228 |
| 596657 | 3/1978 | U.S.S.R. | 148/12.7 A |

*Primary Examiner*—P. W. Echols
*Assistant Examiner*—Andrew E. Rawlins
*Attorney, Agent, or Firm*—Dick and Harris

[57] ABSTRACT

An improved process by which heavy duty aluminum ladder rungs are easily manufactured with the central stepping portion of the rung itself possessing qualities of exceptionally high yield strength, while the ends of the ladder rung are easily formable such that they are readily crimped and secured to the end rail or stile during the ladder assembly process—without cracking or fracturing. In order to maintain high strength at the central portion of the ladder rung while providing for adequate deformability at the ladder rung ends, the invention uses a selective localized heat treating process whereby high frequency induction heating is applied selectivley to the ladder rung ends prior to collar and upset formation.

12 Claims, 1 Drawing Sheet

PROCESS FOR FORMATION OF HIGH STRENGTH ALUMINUM LADDER STRUCTURES

BACKGROUND OF THE INVENTION

This invention relates, in general, to metallurgical fabrication techniques associated with aluminum alloys and in particular to a method for fabricating an improved structure of aluminum ladder. As such, it is an object of the invention to enable high strength ladder rungs to be easily manufactured by a process in which the high yield strength requirements of the central portion of the rung are retained during a selective heat treatment and formation process applied solely to the outer ends of the ladder rungs. The invention entails applying a selective heat treatment process to the outer portion of the ladder rungs only, which enables the ends of the ladder rungs to be first crimped, positioned within the end rails and subsequently flanged, without cracks or fractures occurring during or after the formation process. Localized heating of the ladder end rungs, in the preferred embodiment, is accomplished through the use of high frequency induction heating. And while high frequency induction heat treatment has been utilized in the past for annealing cold worked structures, it has not been contemplated for utilization in an overaging and solution annealing process on fully age-hardened alloy aluminum structures such as the present ladder structures, with the particular problems inherent in their construction.

Certainly prior art processes exist in which selected areas of pipes or tubes are heated during the process of bending of the pipe or tube. The use of heat application for this specific purpose in the past has sometimes been to prevent damage to a coating on the surface of the pipe or tube. Alternatively, heat was applied to a pipe or tube in order to assist in the bending of a pipe. In neither case was heat applied to the tubing for the specific purpose of increasing the formability of age-hardened tubing, while maintaining superior yield strength in the central portion thereof—while rendering increased strength in the formed portion after aging.

Because of the lack of the means by which ductility of the ends of ladder rungs could be increased, while still maintaining high strength at the central portion of the rung, manufacturers of heavy duty aluminum ladders have been limited to a somewhat complex process utilizing several steps including extrusion, cropping, quenching, room temperature aging for twenty-four hours, cold drawing over a mandrel and artificial aging. Most previous attempts at obtaining similar results through the use of a simplified process, comprising only the steps of quenching and artifical aging, have for the most part, proven unsuccessful. In one prior art process, "double-aging" has been utilized in which the entire ladder rung extrusion is first solution annealed, water quenched, then partially aged and cold drawn. The extrusion is then aged at a second temperature, one higher than the first aging temperature. Such a process can be time consuming and expensive.

The innovative process which is the subject of the present invention is capable of producing substantial savings in terms of energy, labor and time, through use of selective heating of ladder rung ends. Moreover, it allows ladder designers of heavy duty ladders to keep the rungs at the preferred weight per foot of 0.300 to 0.350 pounds per linear foot of rung width. And, as a result of these selective heat treatments, each rung so produced is further able to pass rigorous deflection tests in the industry in which a 1,000 pound test load is applied with a maximum permanent deflection of 1/25 of the rung span—all of which is required to obtain a "Type 1A" or "extra heavy duty" rating for a particular ladder design.

As noted above, although a heavy duty ladder rung must withstand a deflection of less than 1/25 of the rung span, upon being subjected to a 1,000 pound bending load for one minute, the metal additionally is expected to be capable of being completely folded back upon itself, while a collar is formed during the operation of securing the ladder rung to the end rails. Without adequate ductility the metal can fracture during the upset operation. As a result, many ladder manufacturers have been unable to consistently produce heavy duty ladders that are able to pass the severe formability requirement, while at the same time maintaining sufficient yield strength in the central ladder portion.

Accordingly, the present invention has, as one of its objects, the provision of a process for facilitating the making of high strength aluminum ladder rungs through the use of selective heat treatment, as applied to only the ends of the aluminum ladder rungs.

It is additionally an object of the present invention to produce an aluminum ladder rung which has better ductility in its end portions such that during the upsetting of the ends, in order to secure the ladder around and to the end rails or stiles, there is less chance for the metal to crack or fracture.

It is a further object of this invention to produce a ladder rung which has a greater yield strength at its central portion so as to bear greater loads during use—without increasing the rung or stile wall width, overall component size or heft.

It is also an object of the present invention to produce a ladder rung which has less deformation at its central portion of the rung while bearing said heavy loads.

An additional object of the present invention is to enable the manufacture of heavy duty ladders with more consistent desireable results, resulting in less fabrication scrap, time and labor lost, often required by the rigorous standards these ladders must meet.

These and other objects of the invention will become apparent in light of the present specification, drawings and claims.

SUMMARY OF THE INVENTION

The present invention comprises a method for forming aluminum ladders with strengthened ladder rung structures in position within co-operating ladder stile members. The method includes the step of firstly age-hardening a plurality of tubular formed ladder rung components to a hardness ranging from 13 to 18 Webster. The extreme ends of these formed ladder rung components, are then selectively softened to a hardness falling within the range of 0 to 12 Webster, through the application of specifically isolated localized and regionally confined heating means. The inventive method, in essence, exploits the experimentally determined realization that end formability of Series 6000 aluminum ladder rungs can become marginal at a Webster hardness of 13—in an environment where hardness and ductibilty are inversely related. At the same time the actual application of the localized heat, at the extreme ends of the ladder rungs, is closely controlled through quickly elevating the temperature of applied heat during said application, and minimizing the amount of time of exposed heating to a substantially brief time period—to further isolate the transmission and conducted migration of applied heat—thereby confining the heat to only the desired end portion.

After the selective softening of the ladder rung ends under substantial control, the rung ends are cooled and collar and upset flanging configurations are formed onto each of the respective ends of the ladder rungs for positioning the ladder rungs into respectively aligned apertures in the ladder stile members. The collar and upset flanging portions of the ladder rungs are then restrainably affixed at the opposite ends of the ladder rungs themselves, in fixed spatial relationship about the inner and outer surfaces of the ladder stiles, respectively. The entire ladder structure, and particularly the ends of the ladder rungs and juxtaposed portions of the ladder stiles, are then exposed to room or ambient temperatures so as to raise the hardness of the treated ladder rung ends, initially softened to less than 8 Webster, to a hardness limit ranging from 8 to 13 Webster. Rung ends selectively softened to the "overlapping" range of from 8 to 12 Webster will not significantly harden with aging but rather will maintain the desired final hardness value sought in the range of from 8 to 13 Webster.

In the preferred embodiment of the invention the ladder rung is selectively softened at each end to a distance of substantially one and one-fourth inches along the longitudinal axis of the ladder rung. In this embodiment the confined selective softening of each end of each ladder rung is accomplished through the utilization of high frequency induction heating elements through the transmission of a high frequency current delivering power in the range of from 20 to 40 kilowatts. This is accomplished through the utilization of a high frequency induction heating element coil which facilitates the selective isolated application of heat to a confined region at each end of the ladder rung. The inductor coil has an internal or inner diameter closely proximate to the exterior or outer diameter of the ladder rung component so as to enable the ladder rung component to be quickly and easily inserted and/or removed from its end position within the inductor heating element coil. This particular construction enables effective dispersion of the required heating energy to selectively soften the opposing ends of the plurality of formed ladder rung components, while simultaneously imparting to the process substantially high speed production techniques that permit quick and efficient heating of the appropriate ladder rung component portions. This, in turn, enables insertion and removal, in a facilitated productive environment, towards efficiently accommodating the further operative steps of collar and upset formation.

In the preferred embodiment, each end of each ladder rung component is heated by the high frequency induction heating element to a temperature ranging from 600° to 1100° F., over a period of time ranging from one-half to ten seconds. As shown in the table set forth hereinbelow, this particular temperature range associated with a particular heat application duration, yields the desired hardness parameters to the finished fabricated ladder structure in accordance with the objectives of the inventive process, in which the desired resulting Webster hardness is sought in the range of nine to thirteen Webster. Higher Webster hardness readings of fifteen and sixteen, for example, are, through the inventive process, sought to be avoided.

| | | AGE-HARDENING PERIOD | | | | | |
|---|---|---|---|---|---|---|---|
| TEMP. | TIME SEC. | 0 Hr. | 2 Hr. | 2 Days | 3 Days | 4 Days | 10 Days |
| 400 | 1 | 16 | 16 | 16 | 16 | 16 | 16 |
| 500 | 1.25 | 14–15 | 15 | 15 | 15 | 15 | 15 |
| 600 | 1.5 | 9–13 | 9–13 | 9–13 | 9–13 | 9–13 | 9–13 |
| 650 | 1.75 | 0–5 | 6–7 | 8–9 | 9 | 10 | 10 |
| 700 | 2.5 | 0–1.5 | 6 | 8 | 9 | 10 | 10 |
| 800 | 3 | 0–1.0 | 6 | 8 | 10 | 10 | 10 |

This above-described accelerated application of generated heat, during the substantially brief time period described, serves to control the selective softening of the ends of each of the ladder rungs to one isolated region, while further controlling against the inadvertent undesired migration of conductive heat from beyond the confined localized region.

The preferred embodiment of the inventive method further includes a series of steps through which the tubular formed ladder rung components are converted into the collar and upset flanging configuration conventionally used in ladder fabrication. The steps of forming these collars and upset flanging configurations are accommodated through mechanically forming a first collar crimp bead inwardly from the tubular end of the ladder rung where the collar bead emanates radially outwardly from the longitudinal axis of the ladder rung component. The free end of the ladder rung immediately adjacent to the collar bead is then placed into and through the aligned respective aperture in the ladder stile, in a manner juxtapositioning the collar bead substantially adjacent the shoulder of the ladder stile aperture. The free end of the ladder rung is then flanged outwardly on the opposite side of the respective ladder stile with the outwardly prompted flange substantially juxtaposing the outer surface of the ladder stile shoulder, immediately proximate to the ladder stile aperture, thereby proximately and restrainably interposing the ladder stile member in juxtaposed relationship, inbetween the first collar bead and the ladder rung flange—for fixed restraint of one thereto the other. In another embodiment of the invention, a first intermediary washer member is preliminarily interposed between the collar crimp bead and the inner surface of the ladder stile shoulder, while a second intermediary stile washer is preliminarily and positively positioned between the outer surface of the ladder stile shoulder and the ladder rung flange—upon formation of that flange.

The selectively heated and formed ends of the plurality of ladder rungs, in one embodiment, may then be quenched at the selectively softened positions now adjacent, affixed to and interposed about the ladder stiles.

Quenching of the selectively heated and formed ends of the plurality of each ladder rung component is accomplished through either ambient temperature air quenching or through ambient temperature water quenching. The preferred embodiment of the inventive method further calls for the age-hardening of the ladder structure after the selective softening formation and affixation operations, whereby the entire ladder structure and particularly the selectively softened ladder rung components (and immediately juxtaposed ladder stile shoulders) are aged at ambient temperatures for a period of at least two to four days.

Furthermore, the inventive method contemplates utilization of a particular series of aluminum alloy, namely that of the 6000 series aluminum alloy which, at the initial stages of the inventive operation, are preliminarily hardened to a hardness of from 15 to 18 Webster.

Although the above heating means involves processing one rung at a time through the induction heater, it is also possible to achieve the same result by inductively heating or using other means of heating, a series of rungs in a ramp or carousel. The present invention further contemplates the utilization of alternative heating means, such as utilization of a radiation heating chamber in which rungs would be inserted in slots (while air blasts cooled the center portion of the rung), as well as alternative heating through preheated pin and collar assemblies.

DETAILED DESCRIPTION OF THE DRAWINGS

Figure 1:
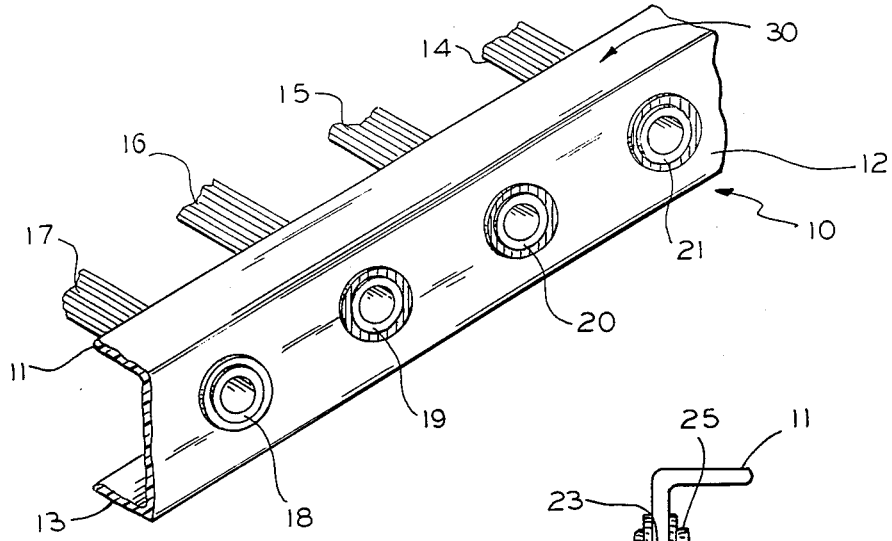
FIG. 1 of the drawings is a side perspective view of a fabricated ladder assembly embodying co-operating, aligned ladder rung and ladder stiles.

While this invention is susceptible of embodiment in many different forms, there is shown in the drawings and will herein be described in detail, one specific embodiment, with the understanding that the present disclosure is to be considered as an exemplification of the principles of the invention and is not intended to limit the invention to the embodiment illustrated.

Ladder structure portion 10 is shown in FIG. 1 as including a plurality of ladder rungs, including ladder rungs 14 through 17 arranged in spaced parallel relationship to each other, with one of each of their opposing ends fixed within ladder stile 30, in stile portion 12, of ladder stile assembly 11 through 13. The exterior flanged portions of ladder rungs 14 through 17 are shown as rung flanges 21, 20, 19 and 18 respectively, in position within ladder stile portion 12.

Figure 2:
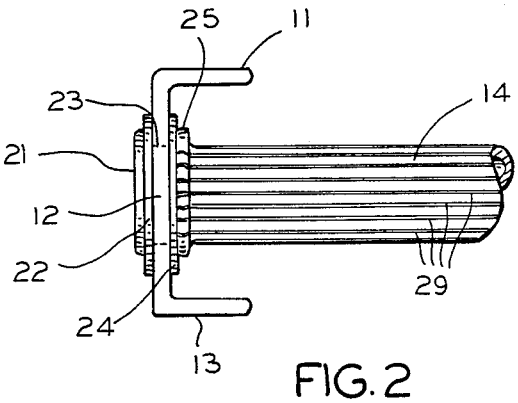
FIG. 2 is an elevated side view of the ladder assembly of FIG. 1 showing, in particular, the arrangement of crimped and flanged ladder rung in interposed affixation with its respective ladder stile, as well as showing first and second intermediary washers associated therewith.

Ladder rung 14 is particularly shown in FIG. 2 as embodying a tubular aluminum ladder rung component, usually having conventional reinforcement ribs such as rib 29 fabricated thereonto for structural and user "stepping" purposes. Rung 14 is mechanically and structurally upset so as to form upset collar 25 for positioning immediately adjacent washer 24. The remaining portion of the protruding end of ladder rung 14 protrudes through the aperture within washer 24, through aperture 23 fabricated within ladder stile portion 12 (having also side portions 11 and 13) as well as protrudes through washer 22 at which point the protruding end of rung 14 is flanged radially outwardly at flange portion 21. Through such a construction, in conjunction with the inventive method described herein, the stile shoulder region positioned immediately adjacent to aperture 23, is interposed or "sandwiched" between collar 25-washer 24 and washer 22-flange 21, for fixable restraint therebetween.

Figure 3:
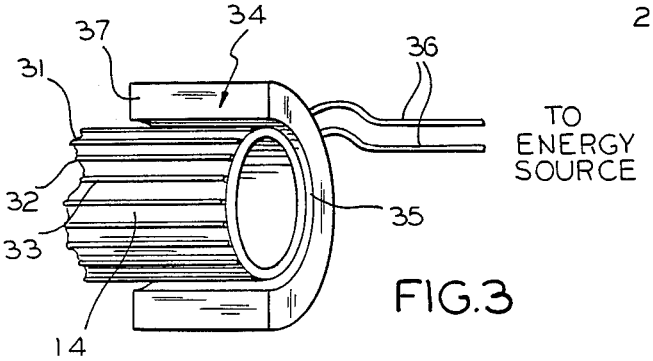
FIG. 3 is a perspective schematic view showing, particularly, the high frequency induction heating coil element positioned about the prescribed portion of ladder rung end, for selective softening the prescribed end portion prior to formation of collar and upset configurations.
Figure 4:
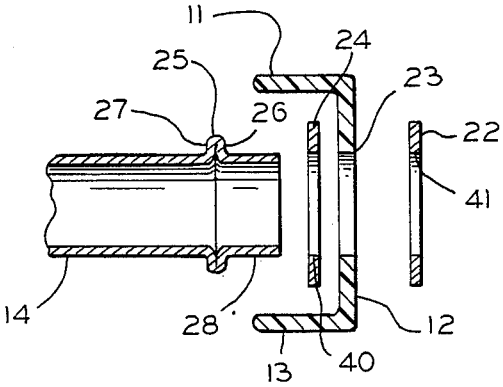
FIG. 4 is an elevated side cross-sectional, exploded, view showing the formation process steps occurring immediately after selective softening, whereby the crimped ladder rung is fabricated with appropriate washers and respective ladder stile into a complete fabricated ladder structure; and, FIG. 5 is a side perspective view of the outer exposed portion of ladder rung fixedly interposed within the ladder stile, particularly showing the flanged affixation structure associated therewith.

High frequency induction heating coil element 34 is shown in FIG. 3 possessed of coil core 37 and interior circumference 35, immediately adjacent and encircling the outer peripheral circumference of well-braced unformed ladder rung 14, without touching the rung with the coil. Also shown in FIG. 3 as fabricated thereonto ladder rung 14, are reinforcement ribs 31 through 33. Upon localized softening of the ladder rung end, collar upset 25, with upset portions 26 and 27, is mechanically fabricated into ladder rung 14, as shown in FIG. 4, with the protruding unformed end of ladder rung 14 being positioned through aperture 40 of washer 24, aperture 23 of ladder stile 12 and aperture 41 of outer washer 22. The outer protruding remainder of ladder rung 14 is then flanged outwardly so as to fixedly restrain and interpose the washers and the ladder stile 12 between upset collar 25 and flange assembly 21.

Figure 5:
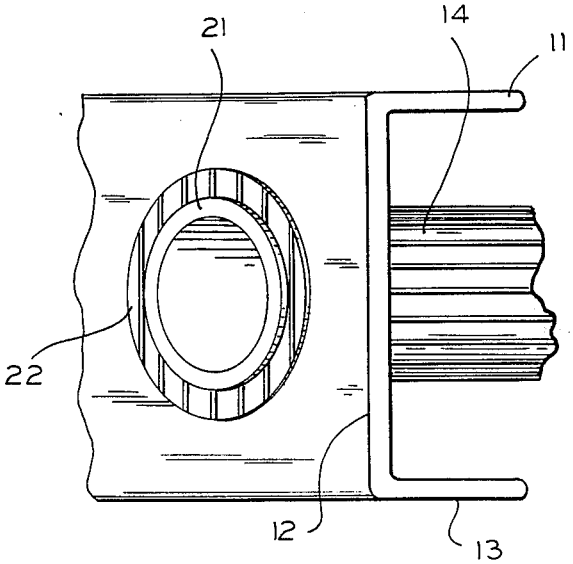

The flange assembly itself is shown in greater detail in FIG. 5 where flange 21 is shown fabricated about and proximate to the outer surface of ladder stile portion 12.

As described, the inventive method disclosed herein includes fabrication of the ladder structure conforming to the structure described in FIGS. 1 through 5 shown in the drawings, in conjunction with the particular methods of treatment applied to the ladder rungs themselves. For example, by way of the present invention, the tubular formed ladder rung components are first age-hardened and then selectively softened through, in the preferred embodiment, induction heating to describe a process of over aging and solution annealing of a fully hardened age-hardenable alloy structure—not the mere selective annealing of a cold worked aluminum alloy structure.

In practice a one and one-half inch diameter induction coil element may be utilized at powers of up to 40 kilowatts to achieve the previously described desired temperature range of 600° to 1100° F. in extremely short periods of time. Additionally in the preferred induction heating embodiment imparting that 600° to 1100° F. temperature range, a substantial but incomplete hardness recovery of the sharp initial hardness decrease occurs at room temperature within a few days. The hardness recovery is of substantial value in the particular application of ladder rung fabrication in order to raise the local shear strength at the ladder rung ladder stile (rail) formed connection.

The foregoing description and drawings merely explain and illustrate the invention and the invention is not limited thereto except insofar as the appended claims are so limited, as those skilled in the art who have the disclosure before them will be able to make modifications and variations therein without departing from the scope of the invention.

What is claimed is:

1. A method for forming aluminum ladders with strengthened ladder rung structures in position within co-operating ladder stile members, the method consisting of the steps of:

age hardening a plurality of tubular, formed ladder rung components to a hardness ranging from 13 to 18 Webster;

selectively softening the opposing ends of each of said plurality of formed ladder rungs to a hardness falling within the range of 0 to 12 Webster through the application of localized and regionally confined heating means while isolating the transmission and conducted migration of said heating means from the regions of ladder rungs between said opposing ends;

closely controlling said application of confined heat means through quickly elevating the temperature of same for a substantially brief time period, to facilitate said isolation of the transmission and conducted migration of same so as to heat only said desired opposing end portions;

said application of confined heat means being controlled by elevating the temperature of each said ladder rung end to a range of from 600° to 1100° F. over a period of time ranging from one-half second to ten seconds;

said accelerated application of generated heat during said substantially brief time period serving to control said selective softening of said ladder rung ends to said isolated region while further controlling against the inadvertent and undesired migration of conducted heat from beyond said confined localized region;

forming collar and upset flanging into each said respective ends of said plurality of ladder rungs for positioning through and into respectively aligned apertures in said ladder stile members;

restrainably affixing the collar and upset flanging portions of said ladder rungs, positioned at opposite ends thereof, in attached spacial relationship about the inner and outer surfaces of each said ladder stile respectively; and exposing the ladder structure so formed and particularly the treated ladder rung ends and juxtaposed portions of said ladder stiles to ambient room temperatures, so as to alternatively age harden treated ladder rung ends softened to a hardness below 8 Webster to a hardness ranging from 8 to 13 Webster, and maintain treated ladder rung ends softened to a hardness ranging between 8 and 13 Webster within said respective range.

2. The method as set forth in claim 1 in which each end of each said ladder rung is selectively softened to a confined longitudinal distance of substantially one and one-fourth inches.

3. The method according to claim 2 in which said confined selective softening of each said end of each said ladder rung is accomplished through utilization of high frequency induction heating elements through transmission of high frequency power in a range of from 20 to 40 kilowatts.

4. The method according to claim 3 in which the high frequency induction heating element for selectively applying heat to a confined region of each end of said ladder rung comprises;

an inductor coil element having an internal diameter closely proximate to the exterior diameter of said ladder rung component so as to enable said ladder rung component to be quickly and easily removably inserted into said inductor heating coil element in order to effectively disperse the required energy to selectively soften the opposing ends of each of said plurality of formed ladder rung components, while enabling the facilitated removal thereof towards accommodating the further operative steps of collar and upset formation in a facilitated productive environment.

5. The method according to claim 1 in which said regionally confined heating means permit the selective softening of said ladder rungs simultaneously in rung groupings.

6. The method according to claim 1 in which each of said plurality of tubular formed ladder rung components is formed into said collar and upset flanging configuration through the steps of:

mechanically forming a first collar crimp bead inwardly from the tubular end of said ladder rung, said collar bead emanating radially outwardly from the longitudinal axis of said ladder rung component, passing the free end of said respective ladder rung component adjacent said collar bead into and through said aligned aperture in said respective ladder stile, so as to juxtaposition said collar bead adjacent the shoulder of said ladder stile aperture, and flanging outwardly the free end of said ladder rung on the opposite side of said respective ladder stile so as to substantially juxtapose the outer surface of said ladder stile shoulder immediately proximate to said ladder stile aperture, thereby proximately and restrainably interpose said ladder style member in a juxtaposed position between said first collar bead and said ladder rung flange for affixation of one thereto the other.

7. The method according to claim 6 in which a first intermediary washer member is preliminarily interposed between said collar crimp bead and the inner surface of said ladder stile shoulder, a second intermediary washer being preliminarily and positively positioned between the outer surface of said ladder stile shoulder and said ladder rung flange upon formation thereof.

8. The method for forming aluminum ladders as set forth in claim 1 in which the invention further includes the step of quenching said selectively heated ladder rungs after affixation of said collar and upset flanging portions.

9. The method according to claim 8 in which said quenching of said selectively heated and formed ends of each of said plurality of each ladder rung component is accomplished through enveloping same in a blast of ambient temperature air.

10. The method according to claim 8 in which said quenching of said selectively heated and formed ends of each of said plurality of each ladder rung component is accomplished through enveloping same in a medium of ambient temperature water.

11. The method according to claim 1 in which age hardening of the ladder structure after selective softening, formation and affixation of the plurality of ladder rung components to said respective ladder stiles, is accomplished through aging the resultant ladder structure at ambient temperatures for a period of at least two to four days.

12. The method according to claim 1 in which said aluminum from which said ladder stiles and ladder rung components are fabricated, comprises 6000 aluminum series alloy preliminarily age-hardened to a hardness of from 13 to 18 Webster.

* * * * *